US005370275A

United States Patent [19]

Mills et al.

[11] Patent Number: 5,370,275

[45] Date of Patent: Dec. 6, 1994

[54] PUMP-MOUNTABLE VALVE FOR SELECTING ONE OF A PLURALITY OF FLUIDS FOR DISPENSING

[76] Inventors: David P. Mills, 563 El Sueno Rd., Santa Barbara, Calif. 93110; Randal N. Kazarian, P.O. Box 40205, Santa Barbara, Calif. 93140

[21] Appl. No.: 943,757

[22] Filed: Sep. 11, 1992

[51] Int. Cl.[5] ..... B67D 5/52

[52] U.S. Cl. ..... 222/136; 222/144.5; 222/383

[58] Field of Search ..... 222/129, 135, 136, 144.5, 222/383; 239/304, 333

[56] References Cited

U.S. PATENT DOCUMENTS

| | | | |
|---|---|---|---|
| 1,964,362 | 6/1934 | Nassif | 222/136 |
| 4,006,841 | 2/1977 | Alticosalian | 222/144.5 |
| 4,355,739 | 10/1982 | Vierkotter | 222/144.5 X |
| 4,549,674 | 10/1985 | Alticosalian | 222/144.5 X |
| 5,009,342 | 4/1991 | Lawrence et al. | 222/136 |
| 5,152,431 | 10/1992 | Gardner et al. | 222/136 |
| 5,152,461 | 10/1992 | Proctor | 222/136 X |

*Primary Examiner*—Gregory L. Huson

*Attorney, Agent, or Firm*—Michael G. Petit

[57] ABSTRACT

An inexpensive adapter enabling the facile manual switching of the fluid uptake port of a standard manually-operated fluid dispensing pump fluid between a plurality of fluid reservoirs. The adapter, which has a low internal dead volume, has an adapter outlet port that is in fluid communication with the fluid uptake port of the fluid-dispensing pump and at least two adapter inlet ports. The adapter inlet ports are in fluid communication with respective fluid reservoirs. The adapter has concentric outer and inner housings. In a preferred embodiment, the outer housing is non-releasably affixed to a fluid dispenser head while the inner housing is releasably affixed to a plurality of fluid reservoirs. The position of the outer housing, which is manually rotated with respect to the inner housing, is determined by means of a spring-loaded detent. Rotation of the outer housing with respect to the inner housing through successive detent stops sequentially fluidly connects the adapter outlet port and, therefor, the fluid uptake port of the fluid dispenser, with one of the plurality of adapter inlet ports which, in turn, are in fluid communication with respective fluid reservoirs.

1 Claim, 4 Drawing Sheets

PUMP-MOUNTABLE VALVE FOR SELECTING ONE OF A PLURALITY OF FLUIDS FOR DISPENSING

BACKGROUND OF THE INVENTION

1. Field of the Invention

This invention relates to a fluid dispensing apparatus, and more particularly, to means for selectively dispensing one of a plurality of fluids housed in separate containers by means of a single dispenser head.

2. Prior Art

There are several types of inexpensive liquid dispensing apparatus presently on the market which incorporate a manually operated reciprocating pump mechanism for the transport of fluid. The dispenser usually includes a screw-on closure to releasably engage a container so that the dispenser may be removed from the container for the purpose of refilling the container. Such dispensers may have a trigger, a plunger or other protruding element which is intended to be moved manually to operate a pump piston in the dispenser, usually against the force of a return spring, so that liquid may be pumped from the container and dispensed through the liquid ejection nozzle or outlet of the device.

Tada, in U.S. Pat. No. 3,701,478 issued Oct. 31, 1972, describes one such hand-held dispenser useful for spraying a fluid. Tyler, in U.S. Pat. No. 3,061,202 describes yet another hand-held spraying head for delivering a fluid from a vessel. Malone, in U.S. Pat. No. 3,650,473, also describes a fluid dispensing head. Corsette, in U.S. Pat. No. 4,618,077, issued Oct. 21, 1986, describes yet another such dispensing head. The foregoing patents describe various hand operated pumps which are well known in the literature and are incorporated herein by reference thereto. They are all hand operated pumps for dispensing fluids from a container. They all include a body containing a pumping chamber having an inlet and an outlet. Such pumps normally have a fluid uptake tube that extends downward from it and into a reservoir containing a fluid to be dispersed, and a screw closure that removably affixes the fluid uptake tube and the dispensing head to the reservoir.

A disadvantage of prior art dispensers is that they are each capable of dispensing only a single fluid. This often limits their usefulness or requires that several dispensers be kept on hand . . . one for each fluid. Or that fluid reservoirs be manually changed when needed. It is therefore the primary object of this invention to provide an adapter for a fluid- dispensing, hand-operated pump, which adapter provides means for the selective dispensation of one of a plurality of fluids housed in their respective reservoirs from a single pump head or dispenser.

Another object of the invention is to provide an adapter for selectively dispensing fluids from a plurality of reservoirs wherein the dead volume holding a fluid within the pump is minimized.

The manner in which the foregoing objects are achieved will be more apparent from the following description, the appended claims and the figures of the attached drawings.

SUMMARY OF THE INVENTION

The invention provides an adapter for a standard pump-type fluid-dispensing head, which enables any one of a plurality of fluids housed in separate reservoirs to be dispensed through the single head without physically disconnecting the dispenser head from the reservoirs. The adapter can be modified to fit most types of hand-held prior art fluid pumps. The adapter has a pump end and a reservoir end. The pump end of the adapter non-releasably attaches to the fluid uptake port of the dispensing pump. The reservoir end of the adapter has projecting therefrom a multiplicity of fluid intake ports in fluid communication with their respective fluid reservoirs; normally by means of siphon tubes therebetween. The adapter provides means for switching the fluid communication between the various fluid reservoirs and the fluid intake orifice of the pump by simple rotation of the adapter between detent stopped positions. An indexing arrow affixed to the adapter indicates which reservoir is being selected for dispensation. A detent, or bump, stops the rotation of the adapter when alignment of the fluid conduit between the appropriate fluid reservoir and the pump fluid intake orifice is achieved.

DESCRIPTION OF THE PREFERRED EMBODIMENT

Figure 1:
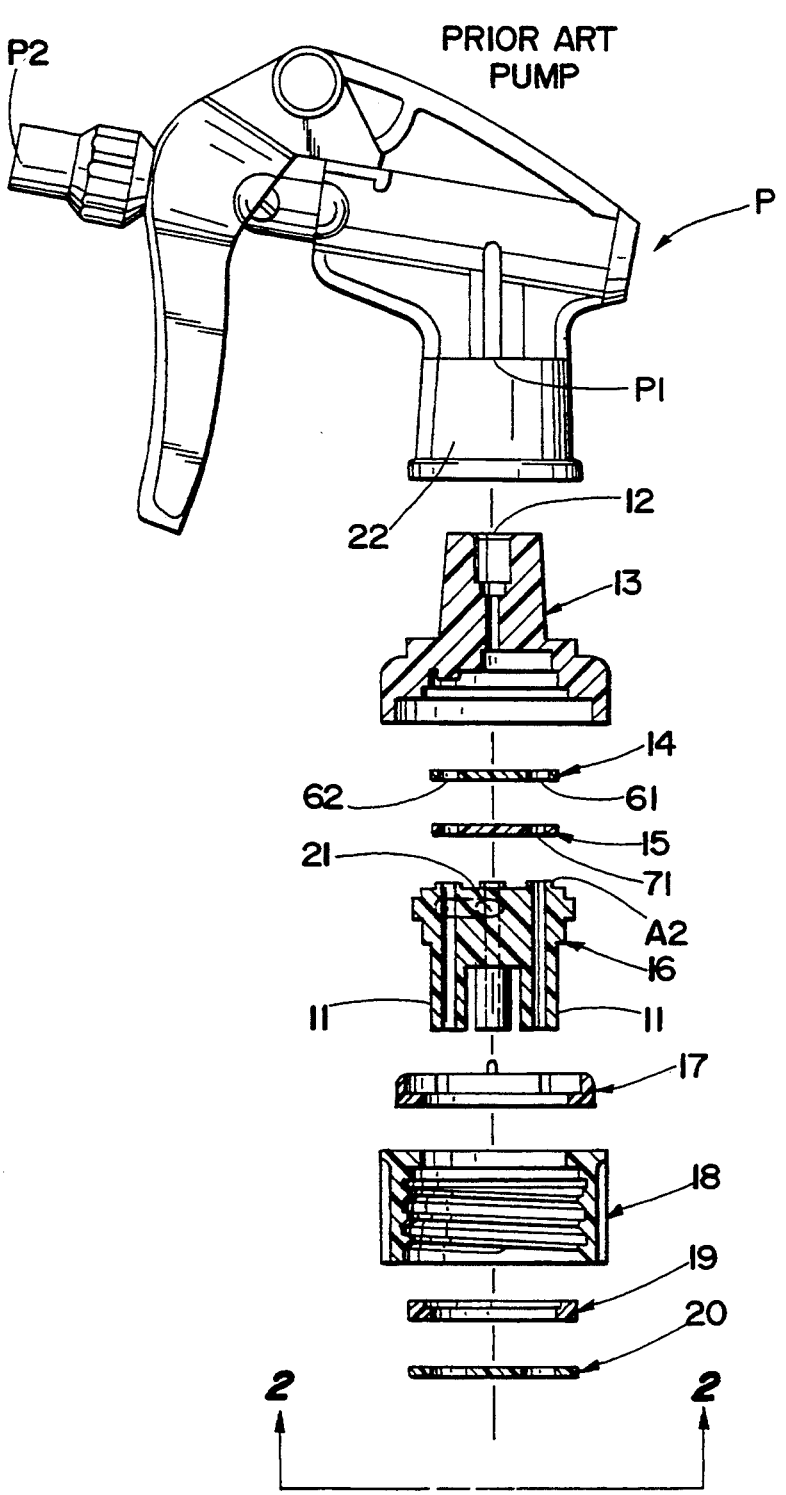
FIG. 1 is a telescopic vertical sectional view of a 4 container embodiment of the adapter assembly of the present invention.
Figure 3:
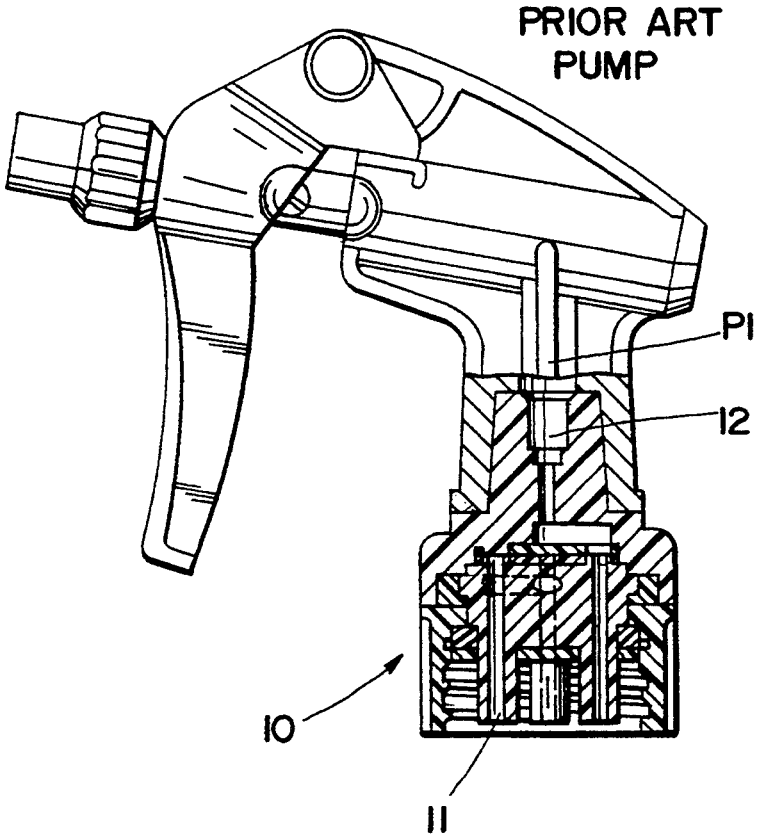
FIG. 3 is a vertical sectional view of the adapter assembly of FIG. 1 fitted into a prior art pump head.
Figure 2:
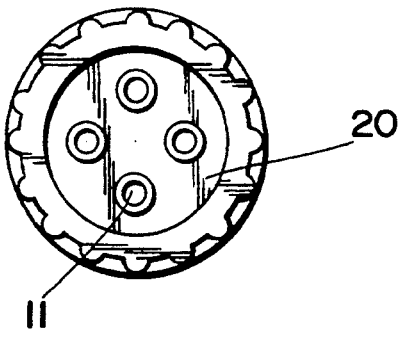
FIG. 2 is a view of the adapter assembly of FIG. 1 along lines 2—2.
Figure 4:
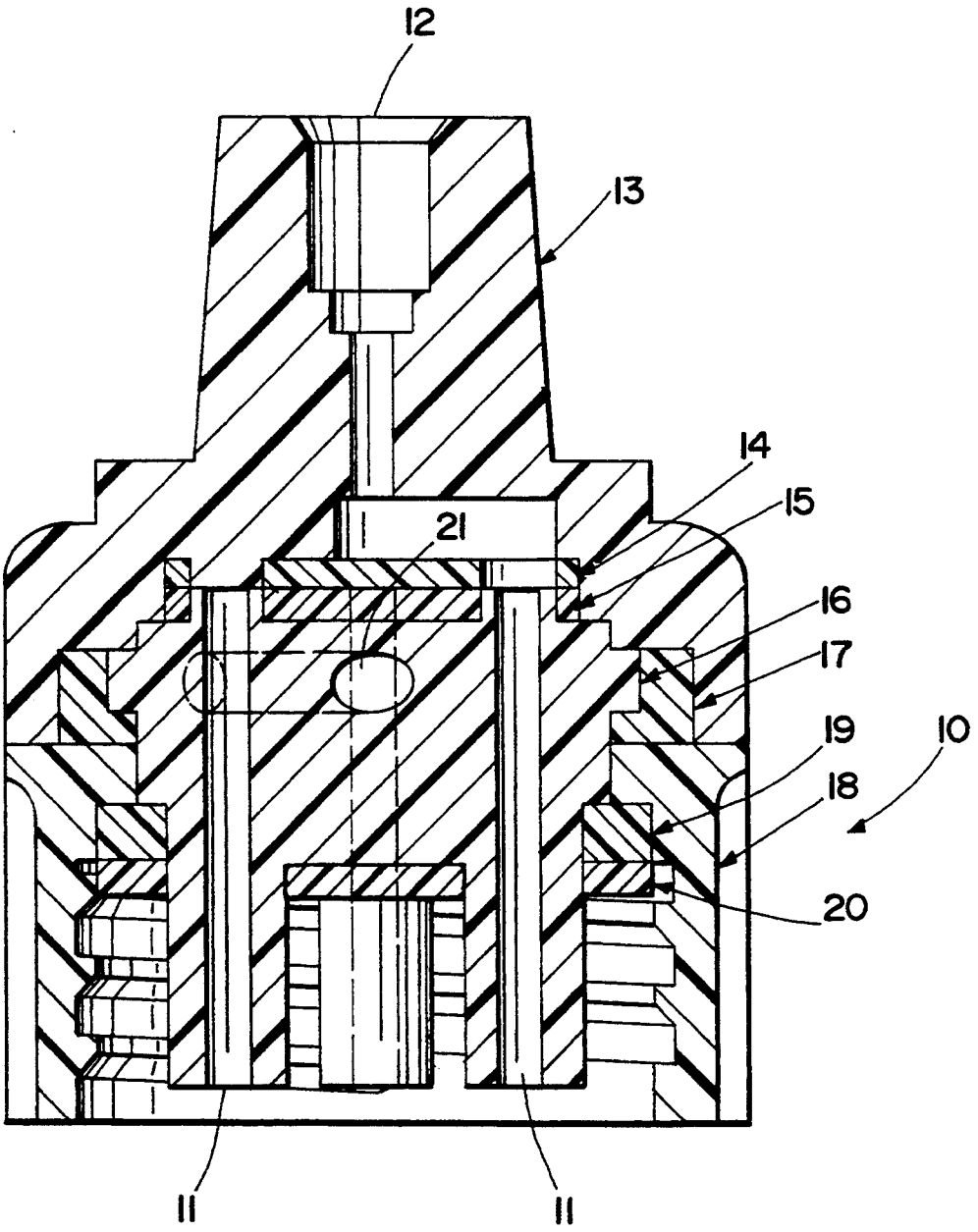
FIG. 4 is an enlarged vertical cross-sectional view of the adapter assembly of FIG. 3, showing one of a plurality of possible fluid paths through the adapter assembly device.
Figure 5:
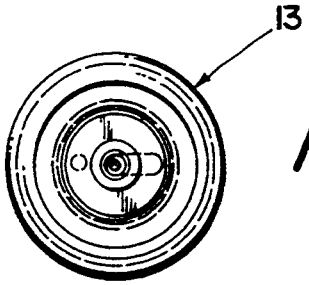
FIG. 5 is a top view of the outer housing of the adapter assembly.
Figure 6:
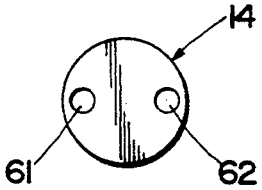
FIG. 6 is a top view of the seal plate of the adapter assembly.
Figure 7:
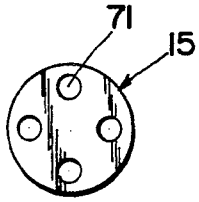
FIG. 7 is a top view of the upper gasket.
Figure 8:
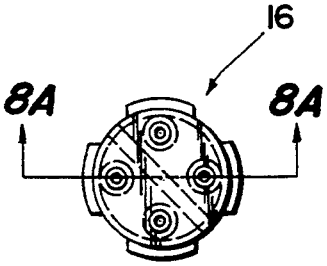
FIG. 8 is a top view of the inner housing of the adapter assembly.
Figure 8A:
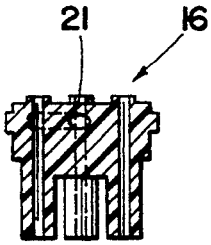
FIG. 8A is a section view of the inner housing along section line 8A—8A.
Figure 9:
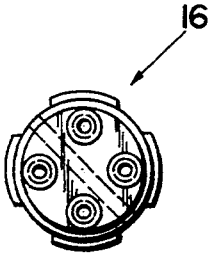
FIG. 9 is a bottom view of the inner housing of the adapter assembly.
Figure 10:
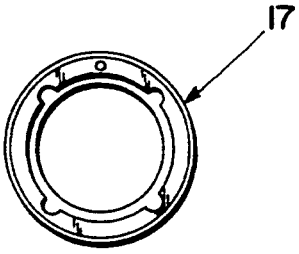
FIG. 10 is a top view of the detent ring of the adapter assembly.
Figure 11:
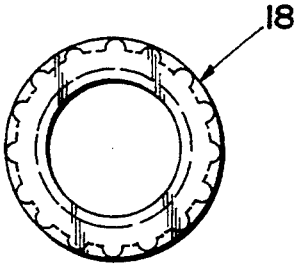
FIG. 11 is a top view of the threaded closure.
Figure 12:
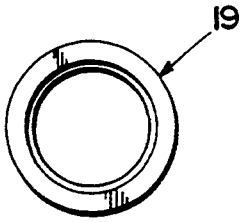
FIG. 12 is a top view of the lower stop ring of the adapter assembly.
Figure 13:
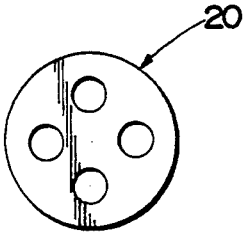
FIG. 13 is a top view of the lower gasket of the adapter assembly.

FIG. 1 shows a vertical telescopic sectional view of the adapter (alternatively referred to herein as a "valve") assembly of the present invention and its structural and functional relationship with the prior art pump head. The pump head P has a fluid intake orifice P1 and dispensing orifice P2 and a conduit (not shown) providing fluid communication therebetween. The adapter assembly of the present invention, generally indicated at 10, has an adapter inlet port, 11, and an adapter outlet port indicated at 12. The adapter inlet port 11 and the outlet port 12 preferably have small diameters and together provide a low-volume fluid conducting conduit through the outer housing 13. The assembly of the dispenser begins with the attachment of the outer housing 13 of the adapter 10 to the prior art pump. The outer housing 13 is dimensioned to fit within the receiving portion 22 of the prior art pump P. The outer housing 13 matingly engages the receiving portion 22 of the prior art pump and is non-releasably affixed thereto. This may be accomplished by adhesion, or by spin welding if there are no receptive threads on the prior art pump head, or by threading the exterior surface of the outer housing 13, in the event there are female threads on the inner surface 22 of the prior art pump. The outlet port 12 of the adapter 10 is adjacent to, and in fluid communication with the pump fluid intake orifice P1. After non-releasably affixing the outer housing 13 to the mating inner surface 22 of the prior art pump, a sealing plate 14 having two holes therein is pressed into the outer housing 13 and bonded thereto as indicated in FIGS. 3 and 4. The holes on the sealing plate 14, shown in FIG. 6, are positioned such that one of them provides an opening into the fluid conduit 12 of the outer housing 13 when the other hole 62 engages a mating projection or key A1 (FIG. 1) on the interior surface of the outer housing 13. Next, an upper gasket 15 is placed against the sealing plate 14. The upper gasket 15 has four holes therein, shown more clearly in FIG. 7, radially located about the periphery of the disk. These upper gasket holes are dimensioned to matingly engage the upper projection of the valve fluid intake orifice projections A2 (FIG. 1) on the top surface of the inner housing 16. The surface of the upper gasket, which is in contact with the sealing plate 14, rotates freely against the sealing plate 14. Next, the inner housing 16 is pressed up against the upper gasket 15 so that the upper projections A2 of the adapter inlet orifices 11 engage the holes 71 in the upper gasket 15. Thus, one of the plurality of valve fluid inlet ports 11 is in fluid communication with the adapter fluid outlet port 12 by rotating the inner housing 16. The inner housing 16 is held in place with respect to the outer housing by means of a detent ring 17. The detent ring 17, shown in more detail in FIG. 10, is bonded to the outer housing 13 and effectively locks the inner housing 16 in place with respect to the outer housing, permitting only rotating motion of the detent ring 17, seal plate 13 and outer housing 14 relative to the inner housing 16. A threaded closure 18 is pressed up against the base of the detent ring 17 and secured in place by a lower stop ring 19 and lower gasket 20.

The assembled adapter is shown in an enlarged view in FIG. 4. The adapter fluid inlet ports 11, which may be any reasonable number, extend down from the adapter and may be connected to separate fluid reservoirs by means of tubes (not shown). By rotating the adapter assembly by grasping the prior art pump head in one hand, the threaded closure 18 portion of the adapter 10 in the other and twisting, the valve outlet orifice 12 is sequentially connected to each one of a plurality of radially distributed fluid inlet ports 11. A registration arrow on the outer housing of the adapter is useful for designating which reservoir is in communication with the pump head. A spring-loaded (not shown) detent comprising a pair of ball plungers separated by a spring is inserted into a tubular chamber 21 within the inner housing 16 so that the ball plungers are pressed radially outwards in the inner housing to seat within detent holes in the detent ring 17. The detent ring 17 is shown in greater detail in FIG. 10. The detent ring 17 consists of an annular member with circumferential indentations therein which indentations matingly engage the ball plungers of the spring-loaded detent housed within the tubular chamber 21 of the inner housing 16.

The foregoing embodiment of the invention is conveniently made of plastic. The adapter 10 may be generally regarded as a selector portion for use with a fluid dispensing device. The complete fluid dispensing device employing the valve 10 of the present invention, has a dispensing head P1, a plurality of fluid-containing reservoirs (not shown) which form a reservoir portion, and a selector portion 10 which provides a selectable fluid-conducting channel between individual fluid reservoirs in the reservoir portion and the dispensing orifice of the dispenser head. Obviously, many of the modifications and variations of the present invention are made possible in light of the above teachings. It is therefore to be understood that within the scope of the appended claims the invention may be practiced otherwise than as specifically described.

What is claimed is:

1. A valve for use with a fluid dispensing pump, said fluid dispensing pump having a pump fluid intake port and a dispensing orifice and a fluidly communicating channel therebetween; said valve enabling the selective dispensation from said dispensing orifice of any one of a plurality of fluids, each said any one fluid being housed in a separate container, said valve comprising: (a) an inner housing having a fluid intake end having (i) a plurality of valve fluid intake ports projecting therefrom, and (ii) means thereon for relesably connecting said fluid intake end of said inner housing to at least two said separate containers; and a first pump end and at least two fluid communicating inner housing channels therebetween; and (b) an outer housing having a second pump end, said second pump end having means thereon for the non-releasable attachment of said outer housing to said fluid intake port of said fluid dispensing pump; and an inner housing end dimensioned to matingly receive said first pump end of said inner housing, and a single outer housing conduit therebetween providing fluid communication between said inner housing end and said pump fluid intake port and wherein said inner housing is rotatable with respect to said outer housing and wherein rotation of said inner housing with respect to said outer housing sequentially brings only one of said at least two inner housing channels into fluid communication with said single outer housing conduit.

* * * * *